United States Patent [19]

Wynnyckyj

[11] Patent Number: 4,518,425

[45] Date of Patent: May 21, 1985

[54] PRODUCTION OF MAGNESIUM METAL

[75] Inventor: John R. Wynnyckyj, Kitchener, Canada

[73] Assignee: University of Waterloo, Waterloo, Canada

[21] Appl. No.: 563,555

[22] Filed: Dec. 20, 1983

[51] Int. Cl.[3] ..... C22B 26/22

[52] U.S. Cl. ..... 75/67 R

[58] Field of Search ..... 75/67 R

[56] References Cited

U.S. PATENT DOCUMENTS 3,427,152 2/1969 Eisenberg et al. ..... 75/67 R 4,389,247 6/1983 Won et al. ..... 75/62

FOREIGN PATENT DOCUMENTS 819412 9/1959 United Kingdom ..... 75/67 R

*Primary Examiner*—Melvyn J. Andrews

*Attorney, Agent, or Firm*—Sim & McBurney

[57] ABSTRACT

Magnesium metal is formed by the silicothermic method in a manner which is a substantial improvement over prior art processes. Magnesium oxide, calcium oxide and silicon are reacted in a heated flowing inert gas stream, for example, hydrogen, argon or helium, which maintains the reaction temperature and removes gaseous magnesium from the reaction zone. Magnesium is recovered from the inert gas stream in liquid or solid form by cooling. Heat recovery is effected to preserve thermal efficiency and the inert gas stream is recycled to the reaction zone. Continuous production of magnesium can be effected.

17 Claims, 3 Drawing Figures

PRODUCTION OF MAGNESIUM METAL

FIELD OF INVENTION

The present invention relates to the production of magnesium metal.

BACKGROUND TO THE INVENTION

One method of production of magnesium metal is by the silicothermic route, using the reaction:

$$2CaO + 2MgO + Si \rightarrow 2Mg + Ca_2SiO_4$$

In one industrial application of this process, the Pidgeon process, a charge of briquetted powders of calcined dolomite (calcium-magnesium oxide) and silicon is placed in an elongate metal retort having an end connected to a vacuum source for application of vacuum to the interior of the tube. The tube is located inside a furnace and is heated to the reaction temperature, about 1200° C., and heat is maintained during the endothermic reaction. Magnesium has a low partial pressure at the reaction temperature, so that vacuum must be applied to draw off vapour phase magnesium and cause the reaction to proceed. Upon encountering a cooler part of the tube, the magnesium condenses. At the end of the reaction, this accumulation of condensed magnesium is removed and remelted in a separate process to recover the same.

This prior art procedure possesses considerable problems, involving the difficulty of heat supply under vacuum conditions, the necessity to use highly skilled labour under very adverse conditions, the necessity to use vacuum in the reaction batch operation, and the limiting of the recovery of magnesium to about 75 to 80% of the theoretical.

There are other industrial processes based on the silicothermic reaction but these similarly possess significant drawbacks, including adverse working conditions and process economics.

SUMMARY OF INVENTION

In accordance with the present invention, an improved process for the recovery of magnesium metal from the silicothermic process is provided. In accordance with the present invention, the reaction of magnesium oxide, calcium oxide and silicon is effected at a temperature of at least about 1000° C. in a flowing, preferably externally-preheated, inert gas stream, usually in a packed bed reactor.

The stream of externally-preheated inert gas has the dual function of supplying process heat and of serving as an entraining medium for gaseous magnesium to maintain its vapour pressure below the equilibrium value. The inert gas leaving the packed bed reactor, after condensation of the magnesium therefrom and heat recovery, is recycled to the reactor.

The process is able to operate in a continuous manner without the environmental and economic problems of the prior art procedures. In addition, the rate of reaction to produce magnesium is considerably increased at the same temperature as compared to the prior art vacuum processes, and the yield of magnesium is similarly increased.

DESCRIPTION OF PREFERRED EMBODIMENTS

Figure 1:
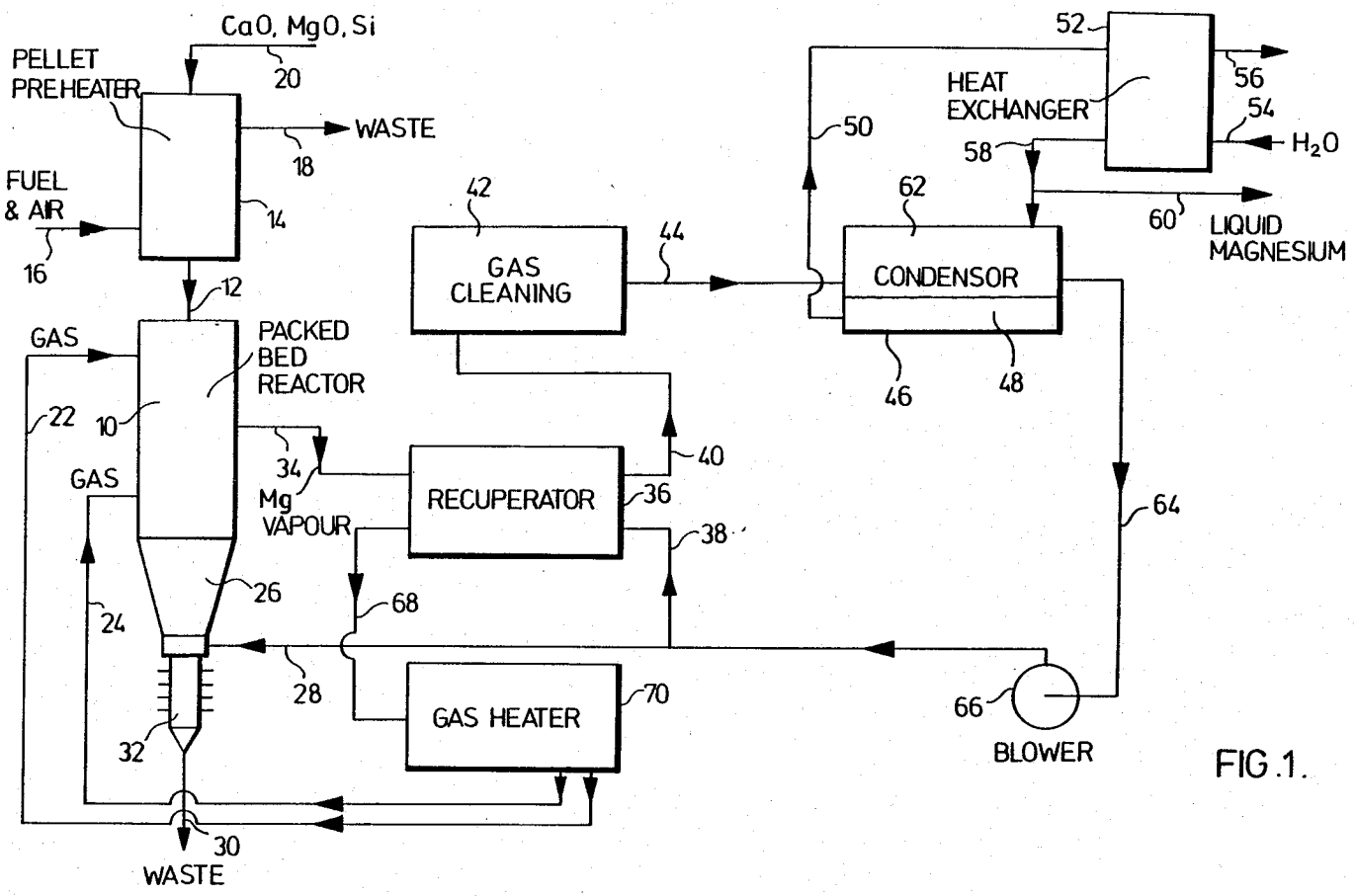
FIG. 1 is a schematic flow sheet of one embodiment of the magnesium production process of the invention.

Referring first to FIG. 1, there is illustrated therein a schematic flow sheet of one preferred embodiment of the invention. A refractory-lined packed bed reactor 10 receives, by line 12, preheated pelletized feed, preferably comprising a pelletized intimate admixture of powdered calcined dolomite and powdered silicon in the stoichiometric amounts to react in accordance with the equation:

$$2CaO + 2MgO + Si \rightarrow 2Mg + Ca_2SiO_4$$

Preheating of the feed pellets to an elevated temperature, usually in the range of about 750° to about 1100° C., preferably about 800° to about 1000° C., is effected in a preheater 14 using combustion of fuel and air fed by line 16, spent gaseous products venting via line 18. The pellets to be heated are fed to the preheater 14 by line 20 from any convenient pelletizer or briquetting press (not shown).

The packed bed reactor 10 also has heated inert gas inlet lines 22 and 24, at or near the top and bottom of the reactor respectively to effect co-current and counter-current flow of heated gas and preheated pellets within the packed bed reactor 10. The heated gas in line 22 is fed usually at a temperature of about 1300° to about 1600° C., preferably about 1450° to about 1600° C., while the heated gas in line 24 is fed usually at a temperature of about 1200° to about 1400° C. The differential in temperature between the gas streams is required in order to heat the preheated pellets to the desired usual reaction temperature of about 1050° to about 1350° C., preferably about 1050° to about 1250° C. and to maintain that temperature during the endothermic reaction. If desired, auxiliary heating of the contents of the reactor 10 may be effected, for example, by using electrical resistance heaters or a gas plasma arc (not shown).

In the packed bed reactor 10, reaction occurs to form gaseous magnesium and solid calcium silicate. The reactants and the gaseous reaction product are highly reactive. Hydrogen, which ordinarily is a strong reducing agent, is inert with respect to the reaction, and may be used as the inert gas fed to the packed bed reactor 10 by inlet lines 22 and 24. Other suitable commercially-available gases are argon and helium. The reactor 10 should be lined with a material which is inert to both the solids and the magnesium vapour. Purified magnesium oxide refractory materials or silicon carbide refractory materials are suitable for this purpose. A cooling gas stream enters the lower solids discharge region 26 by line 28 to cool the calcium silicate prior to discharge to waste by line 30 after further air cooling in discharge pipe 32. The gas stream fed by line 28 then joins with the remainder of the gas in the reactor 10.

The volume of inert gas fed to the packed bed reactor 10 by lines 22, 24 and 28 usually is sufficient, in relationship to the quantity of feed pellets entering the packed bed reactor 10, to form a product gas stream in line 34 containing about 1.0 to about 8.0% by volume of magnesium vapour.

The larger the inert gas volume the more dilute is the magnesium concentration. The process is less costly, both from the point of view of capital investment as well as operating costs, the lower the gas volume. Gas volumes, however, which are too low do not carry sufficient heat into the reactor to result in a sufficiently high temperature and may lead to saturation of the inert gas with magnesium vapour, which stifles the reaction. Under correct design conditions, the process may operate with only an external heat supply but auxiliary heating, internal to the reactor, to raise the temperature of both the charge and the gases, adds process flexibility. However, such auxiliary heating adds to the complexity of the reactor. Accordingly, the chosen flow rate of inert gas and the amount of internal heat supply are the result of a careful balance of technical and economic considerations, which is readily achieved by one skilled in the art. The preferred magnesium concentration in the exit gas stream from the reactor 10 is from about 1.5 to about 6.0% by volume, depending on the particular design chosen for the reactor 10 and the remainder of the steps of the process as described in detail below.

The product gas stream in line 34 is passed through a heat exchanger 36 wherein heat is removed from the product gas stream and used to preheat recycled inert gas stream fed by line 38 to the heat exchanger 36. The heat exchanger 36 may be a regenerative type having a magnesium-resistant lining, usually purified magnesium oxide refractory material or silicon carbide refractory material. Alternatively, the heat exchanger 36 may be a shell and tube type or a plate type, constructed from metallic materials. The product gas stream is cooled in the heat exchanger 36 to a temperature which remains just above the condensation temperature of magnesium, commonly referred to as the dew point, so that the magnesium remains in the vapour phase. The dew point varies with the concentration and is readily calculated using well established physical chemistry formulae.

The cooled product gas stream leaves the heat exchanger 36 by line 40 and is passed through a gas cleaner 42 to remove any entrained solid particulates prior to passage by line 44 to a metal splash condenser 46. In the condenser 46, the gas stream is further cooled below the condensation temperature of magnesium and to near the melting point of the latter, usually to a temperature in the range of about 660 to about 650° C., preferably to about 655° C.

Cooling and condensation of the vapour phase magnesium are effected by withdrawal of liquid magnesium from a pool 48 of liquid magnesium in the condenser 46 by line 50 and passage of that magnesium through a heat exchanger 52 wherein it is cooled by water fed by line 54 to the desired cooled temperature. The cooling in the heat exchanger 52 generates steam which is removed by line 56 and may be used to generate power for the system.

Part of the cooled liquid magnesium resulting from the condenser 52 in line 58 is removed by line 60 as liquid magnesium product and is forwarded for casting as ingots or for providing in any convenient solid form. The remainder of the cooled liquid magnesium in line 58 is sprayed into the vapour space 62 of the condenser 46 to act as nucleating sites for condensation of the vapour phase magnesium in the gas stream. Additional droplets of liquid magnesium are generated by suitable mechanical agitators. The cooled molten magnesium that results is collected in the pool 48 in the condenser 46.

Following condensation of the magnesium vapour therefrom, the inert gas stream is recycled by line 64 to a blower 66. Line 64 may also include a fluidized bed condenser (not shown), if desired, containing a fluidized bed of magnesium particles, wherein the gas stream is cooled to remove residual magnesium. Magnesium has a vapour pressure of about 2 to 3 mmHg at its melting point. The purpose of the fluidized bed condenser is to remove the residual magnesium still contained in the gas stream exiting the condenser 46 and prior to recompression and recycling. Such a fluidized bed condenser usually is operated at a temperature of about 450° to about 550° C., preferably about 530° C.

Power for the pump 66 may be provided by a steam turbine using steam produced in the condenser 52. The pump 66 recirculates the inert gas stream, partly by line 28 directly to the packed bed reactor 10 and partly by line 38 to the heat exchanger 36. In the heat exchanger 38, the gas stream is heated by heat withdrawn from the product gas stream 34, usually to within about 10° to about 100° C. of the temperature of the gas stream exiting the reactor 10, before passage by line 68 to a gas heater 70, which may be electrically powered. The heated gas streams 22 and 24 are removed from the gas heater 70 for passage to the packed bed reactor 10 at the respective temperatures discussed above.

The process as described with respect to FIG. 1 is continuous, with reactants being continuously fed to the reactor 10, waste being continuously discharged therefrom, magnesium vapour being continuously removed from the reactor, and entrainment gas being continuously recycled. Little, if any, make up inert gas is required and the process is thermally efficient, in that recovered heat is reused.

Figure 2:
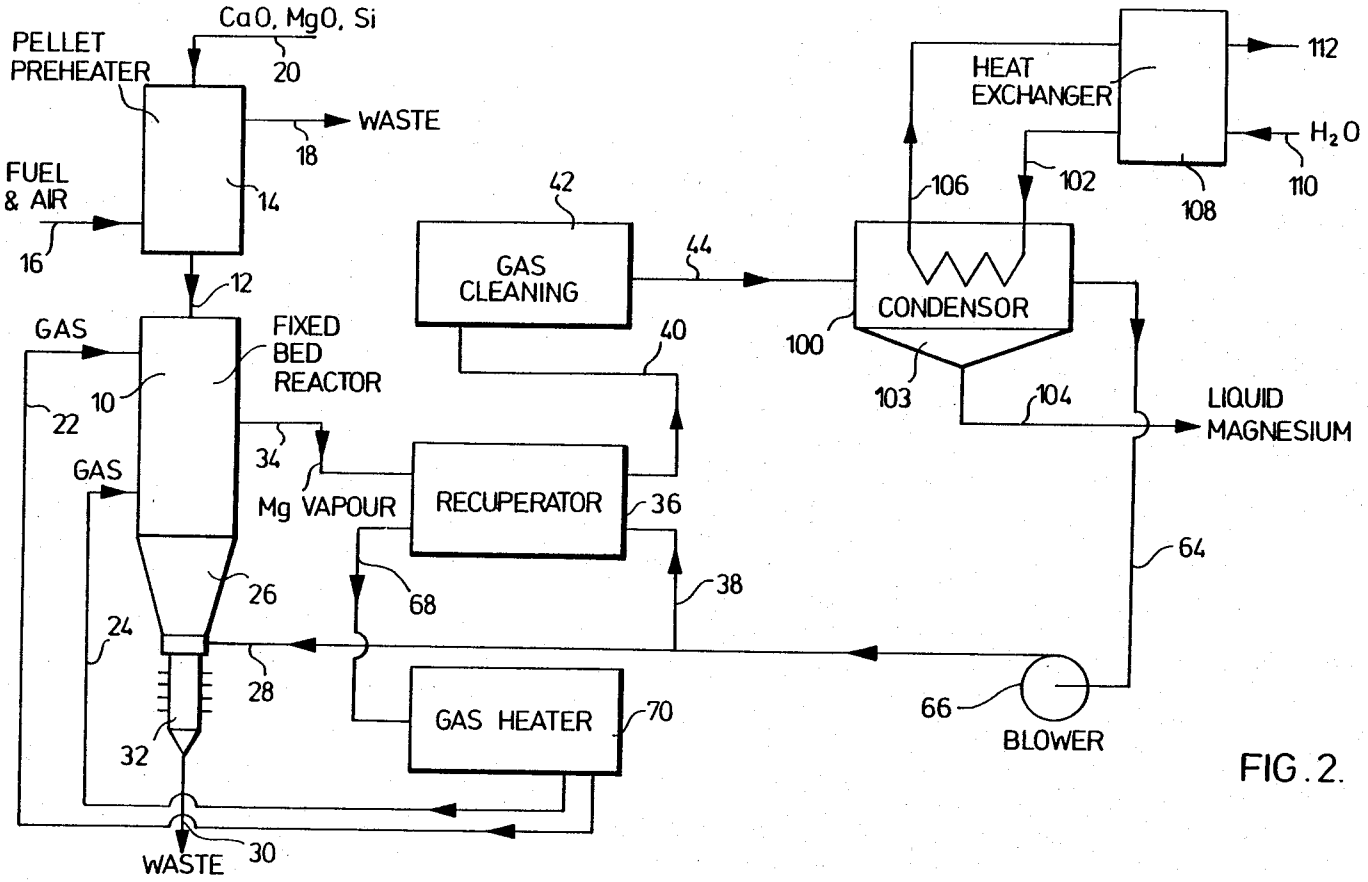
FIG. 2 is a schematic flow sheet of a second embodiment of the magnesium production process of the invention.

Turning now to the embodiment of FIG. 2, this embodiment is similar to that of FIG. 1 with the exception of the manner of condensation of the magnesium from the gas stream. The reference numerals of FIG. 1 are used for the items common to the two Figures. As shown in FIG. 2, the cooled inert gas stream containing magnesium vapour in line 44 is cooled in a magnesium condenser 100 to form liquid magnesium which is removed by line 60.

Indirect heat exchange is used in the condenser 100, in comparison with the direct heat exchange with molten magnesium illustrated in FIG. 1. A mixture of molten alkali metals is fed by line 102 to the condenser 100 to cool the gas stream entering by line 44 to condense magnesium therefrom onto metallic tube surfaces, to form a molten magnesium product pool 103 from which a magnesium product stream is removed through line 104. The heated alkali metal is removed by line 106 to a heat exchanger 108 to which water is fed by line 110 to cool the alkali metal to the temperature desired for feed to the condenser 100. The steam which results from the heat exchange is recovered by line 112 for use in the generation of electric power.

Figure 3:
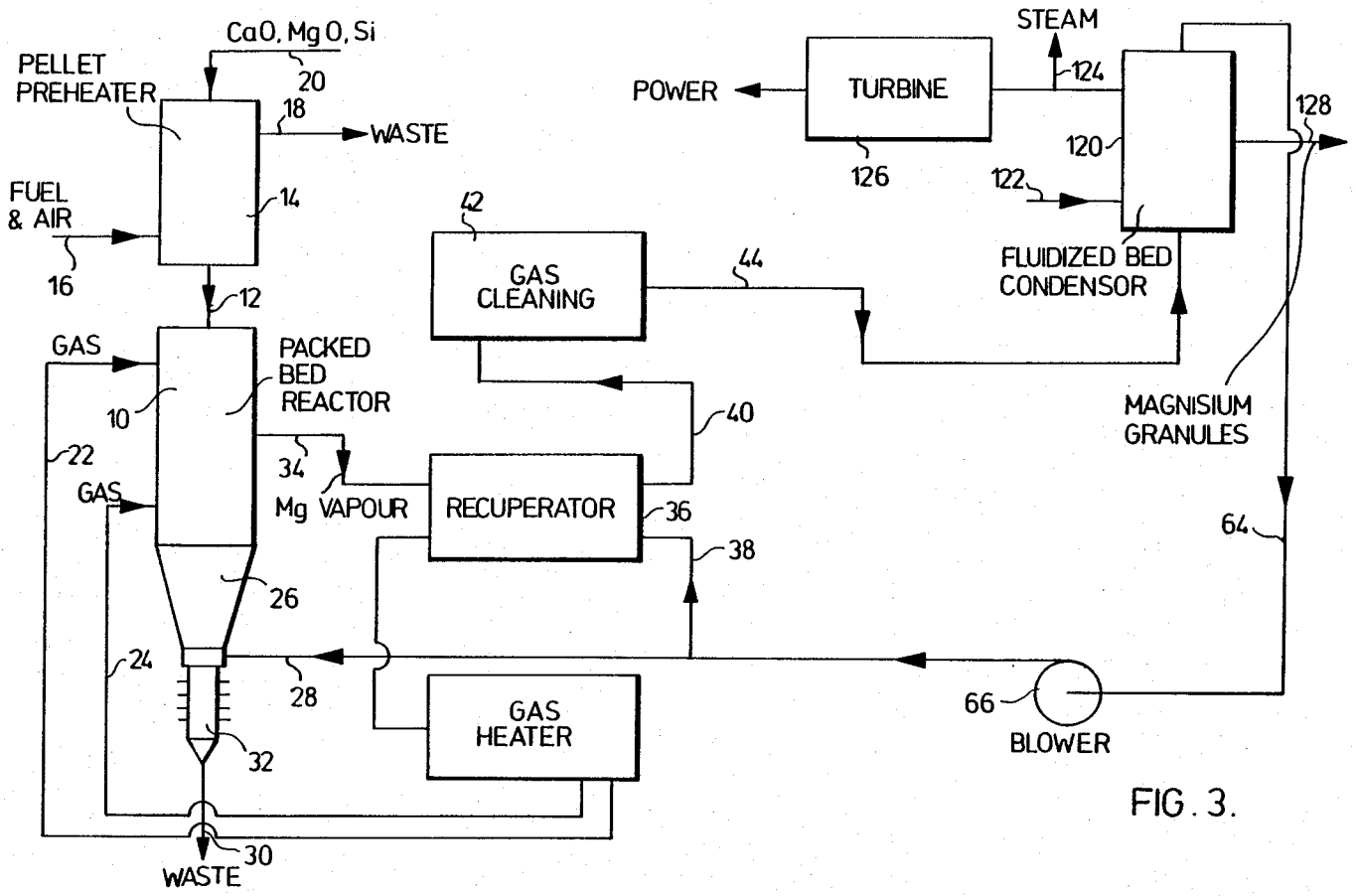
FIG. 3 is a schematic flow sheet of a third embodiment of the magnesium production process of the invention.

The embodiment of FIG. 3 also illustrates a further alternative manner to recovering magnesium from the inert gas stream. Again, the reference numerals of FIG. 1 are used for the items common to the two Figures. In this embodiment, magnesium is recovered in solid granular form by utilizing a fluidized bed condenser 120 to which the magnesium vapour-containing gas stream is fed by line 44. A bed of solid magnesium particles is maintained fluidized by the inert gas stream, while the condenser 120 is cooled indirectly by water fed by line 122 through coils and jackets, producing steam which is removed by line 124, or may be used to generate power using a turbine 126.

The fluidized bed is usually maintained at a temperature of about 450° to about 620° C., preferably about 500° to about 550° C., to effect condensation of the magnesium on the particles inside the fluidized bed. Magnesium granules are removed from the fluidized bed condenser by line 128 on an intermittent or continuous basis.

SUMMARY OF DISCLOSURE

In summary of this disclosure, the present invention provides continuous energy-efficient production of magnesium in rapid manner without encountering the environmental and energy transfer problems of the prior art. Modifications are possible within the scope of this invention.

What I claim is:

1. A method for the production of magnesium, which comprises:

forming a solid feed of magnesium oxide, calcium oxide and silicon and preheating said feed to a temperature of about 750° C. to about 1100° C., forwarding said feed to a packed bed reactor having internal walls resistant to the activity of the reactants therein, preheating an inert gas stream to a temperature sufficient to sustain the reaction temperature in said reactor, feeding said preheated inert gas steam to said reactor in the form of a split stream such that a first portion having a temperature of about 1300° to about 1600° C. flows cocurrently with the solid feed in the reactor and a second portion having a temperature of about 1200° to about 1400° C. flows countercurrently to the solid feed in the reactor, reacting the components of the solid feed in the packed bed reactor in accordance with the equation:

$$2CaO+2MgO+Si \rightarrow 2Mg+Ca_2SiO_4$$

at a temperature of about 1050° to about 1350° C. in the presence of the gas stream, removing a gaseous product stream from the packed bed reactor containing about 1.0 to about 8.0% by volume of magnesium vapour in the inert gas, and discharging by-product solids from the packed bed reactor.

2. The method of claim 1 wherein said magnesium oxide and calcium oxide are derived from calcined dolomite.

3. The method of claim 1 wherein the inert gas is selected from hydrogen, argon and helium.

4. The method of claim 1 wherein the solid feed is preheated to a temperature of about 800° to about 1000° C.

5. The method of claim 1 wherein the first inert gas stream portion has a temperature of about 1450° to about 1600° C.

6. The method of claim 1 wherein the gaseous product stream contains about 1.5 to about 6.0% by volume of magnesium vapour.

7. A method for the production of magnesium, which comprises:

forming a solid feed of magnesium oxide, calcium oxide and silicon and preheating said feed to a temperature of about 750° to about 1100° C., forwarding said feed to a packed bed reactor having internal walls resistant to the activity of the reactants therein, preheating an inert gas stream to a temperature sufficient to sustain the reaction temperature in said reactor and feeding said preheated inert gas stream to said reactor, reacting the components of the solid feed in the packed bed reactor in accordance with the equation:

$$2CaO+2MgO+Si \rightarrow 2Mg+Ca_2SiO_4$$

at a temperature of about 1050° to about 1350° C. in the presence of the gas stream, removing a gaseous product stream from the packed bed reactor containing about 1.0 to about 8.0% by volume of magnesium vapor in the inert gas, discharging by-products solids from the packed bed reactor, initially cooling the gaseous product stream to its dew point, subsequently cooling the gaseous product steam to effect condensation of magnesium from the gaseous products stream, recycling the inert gas stream remaining from the condensation of magnesium in heat exchange relationship with said product gas stream during said initial cooling step to heat the inert gas stream, and recycling the inert gas steam to the packed bed reactor after reheating to the required temperature at least partially by said heat exchanger.

8. The method of claim 7 wherein the further cooling is effected to a temperature of about 660° to about 650° C. to effect condensation of the magnesium in liquid form.

9. The method of claim 8 wherein said further cooling to effect condensation in liquid form is effected by contacting said gaseous product stream with a spray of droplets of molten magnesium to act as nucleation sites for condensation of magnesium from the gaseous product stream.

10. The method of claim 9 wherein the temperature is maintained and the liquid magnesium spray is formed by withdrawing liquid magnesium from a bath thereof, cooling the withdrawn liquid magnesium, forming a spray of magnesium droplets from part of the cooled magnesium, and recovering the remainder of the cooled magnesium.

11. The method of claim 8 wherein said further cooling to effect condensation in liquid form is effected by indirect heat exchange using liquid alkali metals as coolants.

12. The method of claim 7 wherein said further cooling is effected by contacting said gaseous product stream with solid magnesium particles in a fluidized bed at a temperature of about 450° to about 620° C.

13. The method of claim 1 wherein said packed bed reactor is lined with a lining of purified magnesium oxide refractory material.

14. The method of claim 1 wherein said packed bed reactor is lined with a lining of silicon carbide refractory material.

15. The method of claim 1 wherein said packed bed reactor includes electrical resistance heaters to control the reaction temperature therein.

16. The method of claim 1 wherein said packed bed reactor includes a gas plasma arc to provide heat to control the reaction temperature therein.

17. The method of claim 7 wherein said inert gas stream is reheated from a temperature of about 450° to about 620° C. to about 1250° to about 1600° C. during said heat exchange operation.

* * * * *